United States Patent [19]

Cornwell

[11] 3,938,030

[45] Feb. 10, 1976

[54] CONTROLLABLE POWER TRANSFERRING DEVICE UTILIZING A SHORT-CIRCUITED CONTROLLED REACTANCE

[76] Inventor: Lionel B. Cornwell, 52 Madison Springs Drive, Madison, Conn. 06443

[22] Filed: July 18, 1974

[21] Appl. No.: 489,783

[52] U.S. Cl. ..... 323/50; 323/62; 323/86; 323/87

[51] Int. Cl.[2] ..... G05F 7/00

[58] Field of Search ..... 323/6, 50, 62, 85–88, 323/45, 57

[56] References Cited

UNITED STATES PATENTS

| | | | |
|---|---|---|---|
| 1,901,768 | 3/1933 | Norris | 323/45 |
| 2,907,946 | 10/1959 | Hooper, Jr. | 323/87 X |
| 3,184,675 | 5/1965 | Macklem | 323/86 X |
| 3,199,018 | 8/1965 | Macklem | 323/50 X |
| 3,466,531 | 9/1969 | Chin | 323/86 |
| 3,624,491 | 11/1971 | Fidi et al. | 323/62 X |
| 3,739,257 | 6/1973 | Hunter | 323/50 |

FOREIGN PATENTS OR APPLICATIONS

| | | | |
|---|---|---|---|
| 397,856 | 8/1933 | United Kingdom | 323/50 |
| 412,545 | 9/1932 | United Kingdom | 323/50 |

*Primary Examiner*—Gerald Goldberg
*Attorney, Agent, or Firm*—Joseph L. Lazaroff

[57] ABSTRACT

A controllable power transferring device of the type used for controlling or regulating the application of A.C. electric power to a load by means of a reactance controlled by selectively short-circuiting a control coil with a controllable short-circuiting switch such as an SCR. The device employs a power transformer with a power core and a primary coil and a secondary coil each encircling the power core. A control core, separate from the power core, is encircled by the selectively short-circuited coil and is also encircled by one of the primary or secondary coils to subject that coil to the controlled reactance of the control core. By arranging the primary or secondary coil to encircle both independent cores, more efficient use is made of core and coil material, and more efficient controlled power transfer is obtained.

17 Claims, 10 Drawing Figures

Fig. 1.
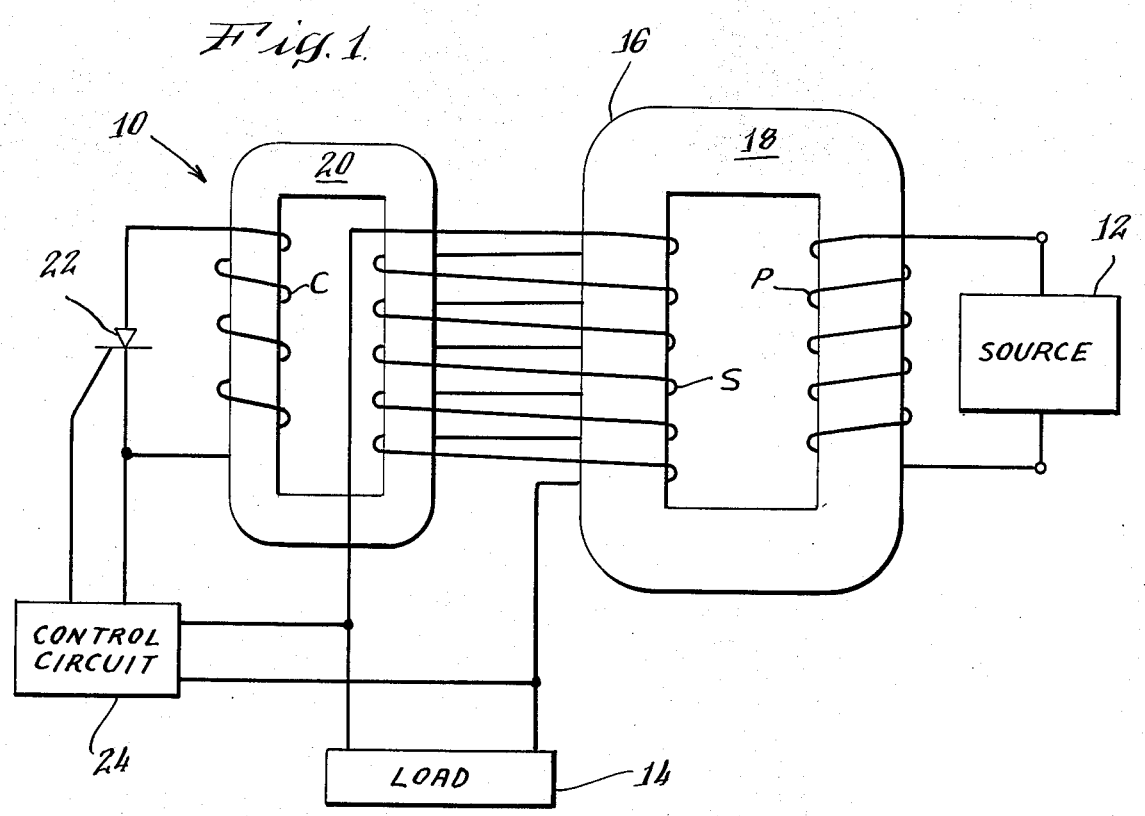
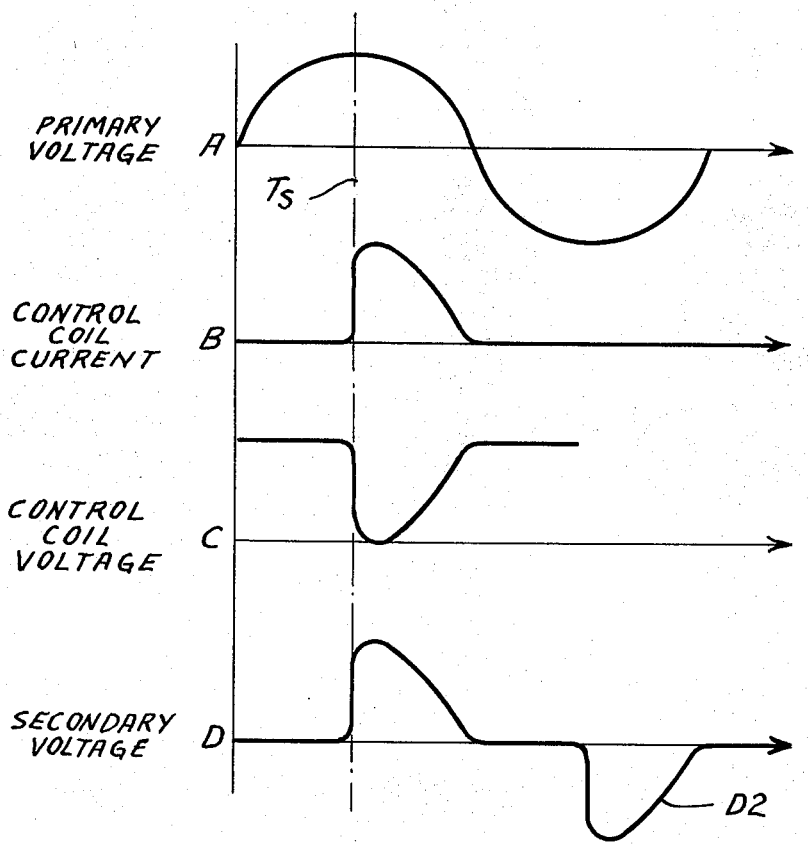
Fig. 2.

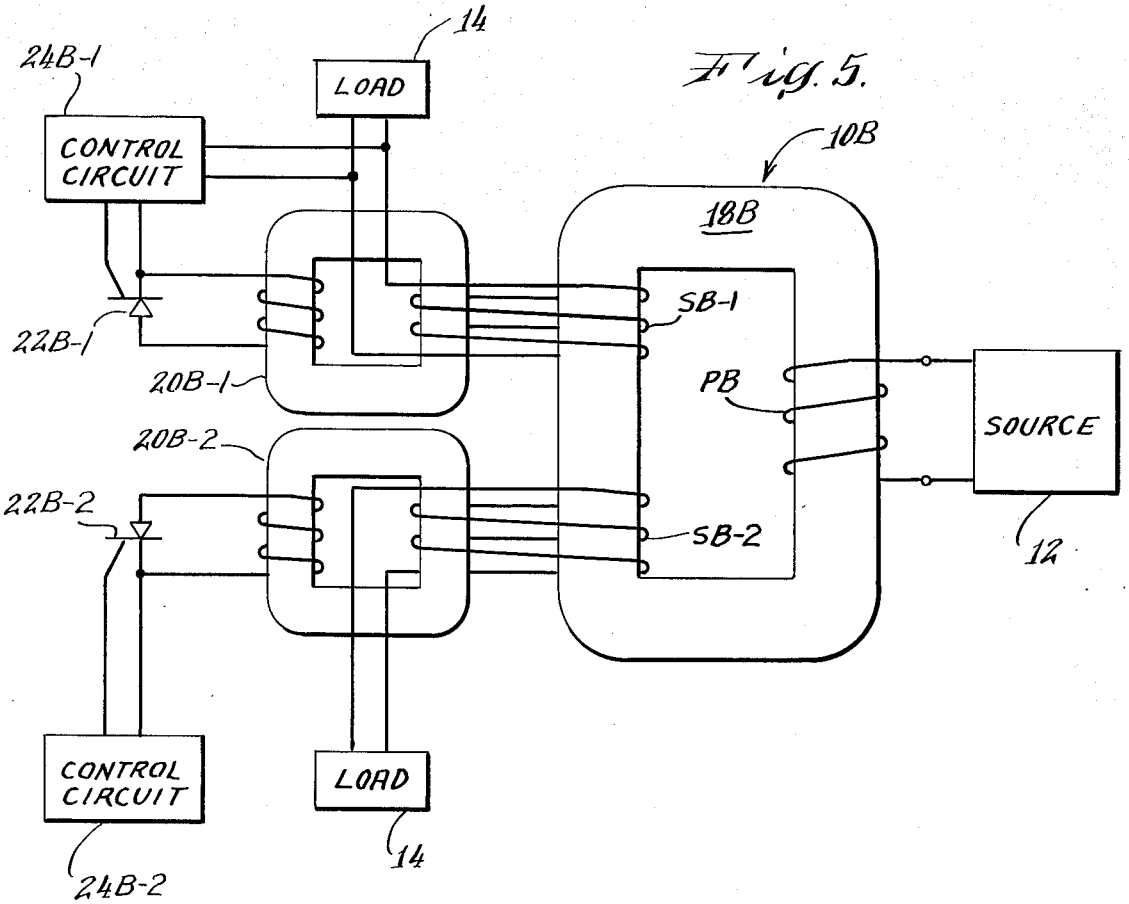
Fig. 5.
Fig. 6.
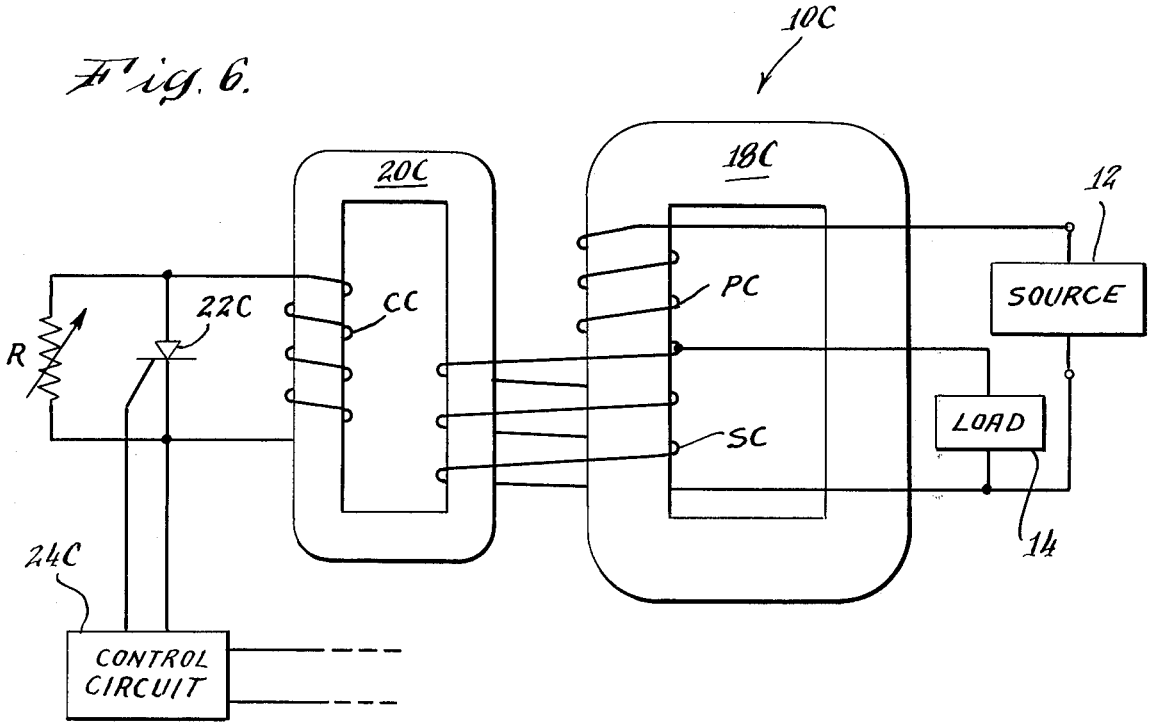

Fig. 7.
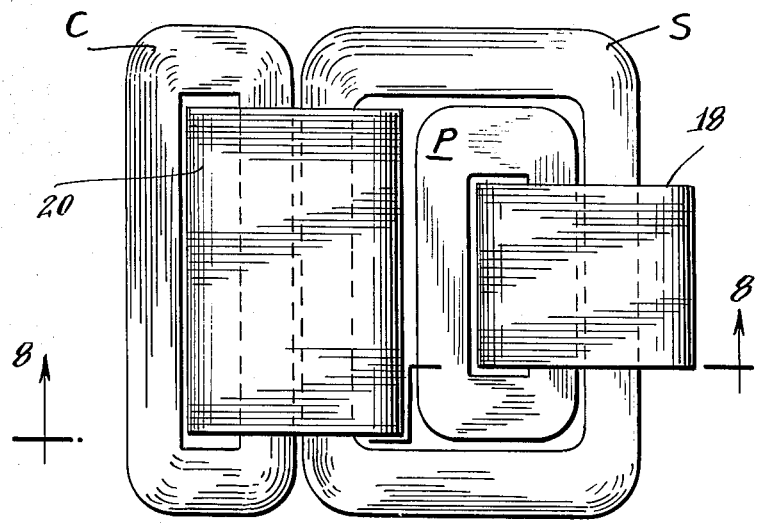
Fig. 8.
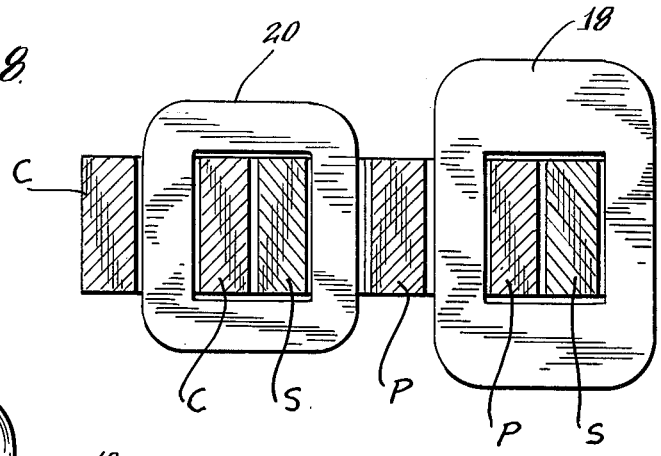
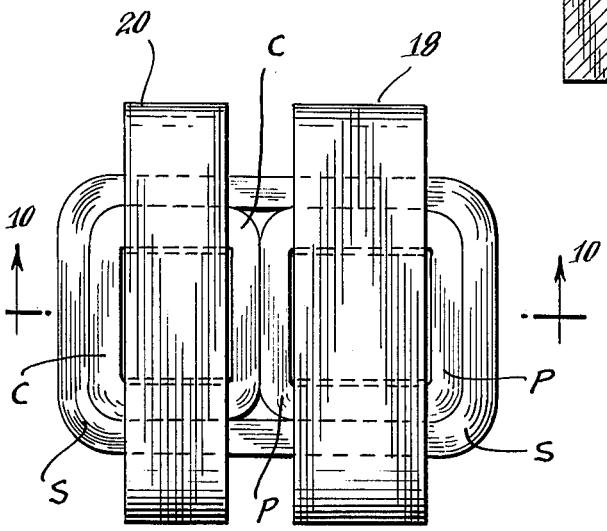
Fig. 9.
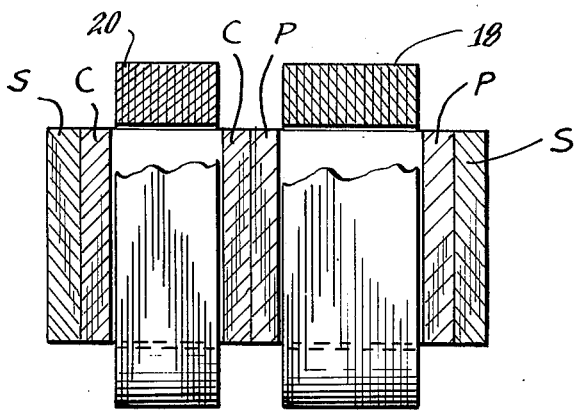
Fig. 10.

CONTROLLABLE POWER TRANSFERRING DEVICE UTILIZING A SHORT-CIRCUITED CONTROLLED REACTANCE

BACKGROUND OF THE INVENTION

1. Field of the Invention

The present invention relates to the field of controlled electric power transfer of the type designed, for example, to control or regulate the supply of alternating current electric power to a load in response to a device sensing voltage, current, temperature, motor speed, humidity, or another similar characteristic or quantity.

The present invention relates more particularly to a form of electric power control achieved by means of a variable reactance having a control coil selectively shortcircuited to cause the loading of a core and to decrease the reactance of another winding about that core. This form of power control has a number of advantages. Large amounts of power can be controlled using controllable short-circuiting switches, such as SCR's and other thyristors, of lesser power handling capacity. Precise control can be achieved, and the power used in controlling is small. In addition, capacitative switching effects are masked.

2. Description of the Prior Art

Various known arrangements achieve power regulation by periodically loading a control core with a selectively short-circuited control coil. Examples of such arrangements are shown in the following U.S. Pat. Nos.: 3,184,675 (Macklem); 3,199,018 (Macklem); 3,103,619 (DuVall); 3,573,605 (Hart); 3,739,257 (Hunter); 3,295,053 (Perrius); 2,725,508; 2,497,218; 3,065,399; 2,767,364; and 3,182,249.

Although the arrangements described in the foregoing patents are able to provide power control, they have not been fully satisfactory. Considerable amounts of magnetic core material and copper coil material are needed to provide sufficient reactance for control in the known arrangements. Moreover, power dissipation in the short-circuited control coil often is at a level high enough to create design problems. Finally, such known control arrangements often do not provide good efficiency in terms of power transfer.

SUMMARY OF THE INVENTION

It is a primary object of the present invention to provide an improved power transferring device of the type used for regulating or controlling the application of electric power by means of a reactance controlled by selectively short-circuiting a control coil with a controllable short-circuiting switch. It is a specific object of the present invention to provide a controllable power transferring device of this type which requires less core and coil material in order to achieve control, which requires less power dissipation in the control coil, and which provides efficient power transfer. It is a further object of the present invention to provide a controlled power transfer device which is more satisfactory commercially.

In accordance with the present invention, the controllable power transfer device includes a power transformer having a power core and primary and secondary coils each encircling the power core. Typically the primary and secondary coils are arranged to be connected respectively to means acting as a source of alternating current electric power and to means forming a load. A control core, separate from the power core and providing an independent flux path, is encircled by the selectively short-circuited control coil. One of the primary or secondary coils is arranged to have its winding encircle both the control core and the power core, thereby to subject that coil to the controlled reactance of the control core to achieve controlled power transfer. Several major advantages result from this arrangement: less core and coil material is needed to obtain power control, less power need be dissipated in the control coil, and greater efficiency of power transfer is obtained.

In various other aspects of the invention a booster coil around the power core is connected additively to the control coil, the control coil is segmented with separate short-circuiting switches for each segment, and the power core is coupled with multiple control cores and secondaries to provide multiple control.

Other objects, aspects and advantages of the invention will be pointed out in, or apparent from, the detailed description hereinbelow, considered together with the following drawings.

DESCRIPTION OF THE DRAWINGS

FIG. 1 is a schematic diagram illustrating a controlled power transfer device in accordance with the present invention;

FIG. 2 is a graph showing typical signals in the power transfer device of FIG. 1;

FIGS. 3, 4, 5 and 6 are schematic diagrams illustrating modified power transfer devices in accordance with the present invention; FIGS. 7–10 are views showing practical constructions for controlled power transfer devices in accordance with the present invention;

FIG. 7 is an elevation of one form of contruction;

FIG. 8 is a section on line 7—7 of FIG. 6;

FIG. 9 is an elevation of a second form of construction; and

FIG. 10 is a section on line 9—9 of FIG. 8.

DESCRIPTION OF THE PREFERRED EMBODIMENTS

Figure 3:
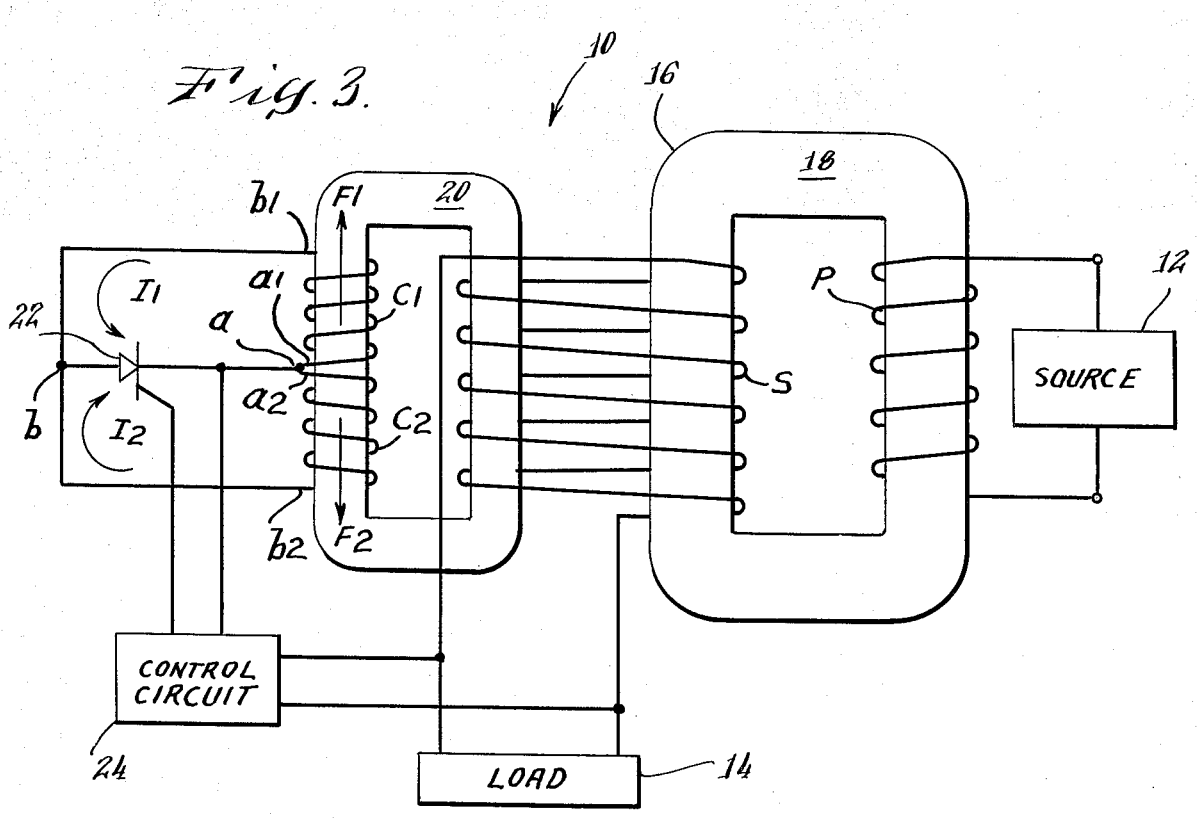

FIG. 1 illustrates schematically a controlled power transfer device 10 constructed according to the present invention and arranged to transfer controlled amounts of power from a source 12 of alternating current electric power, such as standard line voltage, to a load 14, such as a motor, an instrument, a heater, or other power consuming element.

The controlled power transfer device 10 shown in FIG. 1 comprises a power transformer 16 having a power core 18 of magnetic material, a primary winding or coil P encircling the core 18 and connected to the power source 12, and a secondary winding or coil S encircling the core 18 and connected to the load 14. Power core 18, primary P, and secondary S form a standard transformer and are designed accordingly.

The controlled power transfer device 10 further includes a control core 20 of magnetic material, separate and independent from power core 18. As shown in FIG. 1, secondary coil S of power trnasformer 16 is arranged to have its loops encircle control core 20 in addition to power core 18. A control coil C encircles control core 20 and is connected across a controllable short-circuiting switch element 22, such as the illustrated SCR, which is connected to respond to control or gating signals supplied by a control circuit 24, typically in response to a sensed load condition such as load voltage as depicted in FIG. 1, or current, motor speed, temperature, humidity, or the like. The controllable short-circuiting switch 22 preferably has low impedance and low power consumption during conduction, and high impedance otherwise. SCR's, triacs, and other devices in the thyristor family, as well as transistor switches, are suitable for various applications. The control circuit 24, which may be of various known constructions, supplies a gating signal to the switch to control its conduction. The control circuit typically gates the switch 22 into conduction at a selected phase angle during each cycle of operation, with so-called "phase angle firing," the phase angle being selected either manually, or automatically in accordance with control circuitry.

The operation of controlled power transfer device 10 is as follows. In normal transformer operation, current flowing through primary coil P creates a magnetic field in power core 18 which in turn induces a voltage across secondary coil S and tends to cause a current to flow through secondary S and load 14. Secondary coil S, however, in accordance with the present invention also loops or encircles control core 20 and thus is subject to a controlled reactance which influences the amount of power the secondary coil S can apply to load 14.

When control coil C is open-circuited, the control core functions as a reactive choke: the magnetic field created in control core 20 develops a counter electromotive force that opposes the flow of current in the secondary coil S and thereby limits power. Control core 20 contains sufficient cross-sectional area to provide enough reactance to achieve essentially complete choking without saturation. Power transfer rates between primary and secondary of as low as approximately 0.5 percent are obtained in this condition. A particular advantage of the present invention is that because secondary coil S encircles both power core 18 and control core 20, smaller amounts of magnetic material are needed in control core 20 to obtain sufficient reactance for full choking without saturation. Moreover, since the same turns of secondary S encircle both cores, less copper coil material is needed than would be required for a series-connected saturable reactor.

Power control is achieved by selectively shorting control coil C. When control coil C is short-circuited, current flows in the control coil C to load the control core 20. With this loading, the counter electromotive force opposing current flow in secondary S disappears, and power flows essentially unimpeded from primary P to secondary S. The impedance across control coil C which is reflected into secondary coil S drops to the small value represented by the resistance of the control coil C and switch 22. By designing the control coil C to have approximately the same ampere turn capacity as the secondary possesses at full load, the current flow in control coil C never is required to rise to a significant level. This results because the voltage induced across the control coil drops to the value needed to overcome the small D.C. resistance of the control coil C and switch 22. A further advantage of the invention is that because the control core 20 may have a smaller cross-sectional area, a smaller loading current is required in control coil C. This small current flows through only the small resistance existing in control coil C and switch 22 during conduction. Accordingly, only small amounts of power are consumed in order to achieve control, and efficient power transfer results. During full loading, power transfer rates between primary and secondary of as high as about 98 percent are obtained. This compares favorably with efficiencies of 40–80 percent for ferroresonant devices and for conventionally constructed power supplies.

By suitably controlling short-circuiting switch 22 to provide different ratios of time for the choking and loading conditions of operation, power transfer rates may be arbitrarily selected in a continuously variable wide range of control.

Waveforms showing an example of operation of power transfer device 10 are shown in FIG. 2 with a common horizontal time scale. In this example, the short-circuiting switch 22 is gated at a 90° phase angle to provide approximately a 50 percent power transfer rate. Curve A indicates the sinusoidal input voltage across primary coil P. Curves B and C show respectivley current in and voltage across the control coil C. Switch 22 is short-circuited at time Ts, and it can be seen that control coil voltage drops to a low value while control coil current rises to a higher level to load control core 20. Curve D shows the output voltage across secondary S. Before time Ts, the output voltage is essentially zero, and after time Ts, the voltage follows the input voltage across primary coil P. It will be noted that even though switch 22 is a unilaterally conducting element, such as an SCR, which operates only in one half of a cycle, the demagnetization of control core 20 in the second half of the cycle will produce a second output wave D2 of opposite polarity, thus affording essentially full wave control. It should be further noted that the output wave is smooth and well-behaved with no large magnitude voltage spikes or high frequency transients present in many switching type power controls, such as in simple series SCR controls.

FIG. 3 illustrates a power transferring device 10' with a power core 18, primary coil P, secondary coil S, and control core 20 arranged as described above with reference to the device 10 shown in FIG. 1. Device 10', however, employs two control coils C1 and C2 encircling control core 20.

The control coils C1 and C2 are provided with the same number of turns, but are oppositely wound on core 20 and have their common polarity ends a1, a2 and b1, b2 connected together as shown at points *a* and *b* to form a closed series loop. A short-circuiting switch 22' such as an SCR, joins points *a* and *b* and is gated by control circuit 24. When switch 22' is not conducting, coils C1 and C2 are in series and flux created in control core 20 by secondary S induces equal and opposite cancelling voltages across coils C1 and C2 and no current flows in the coils. A high impedance accordingly reflects back to secondary S and prevents transfer of power to load 14. When switch 22' conducts, control coils C1 and C2 each become shorted and currents I1 and I2 flow through the coils and through switch 22'. Since the resistances of the coils C1 and C2 are equal, currents I1 and I2 will be equal and will induce equal magnetic fluxes F1 and F2 which oppose one another and cancel. The two short-circuited coils C1 and C2 reflect a small impedance to secondary coil S and power is transferred substantially unimpeded to load 14.

Because coils C1 and C2 and switch 22' have small resistances, little power is consumed during control and high power transfer efficiencies are obtained. Moreover, because fluxes F1 and F2 cancel, eddy current losses in control core 20 decrease and efficiency is further enhanced. Experimental observations further indicate that opposed coils C1 and C2 respond to phase angle firing of switch 22' in a fashion which yields an output waveform from secondary S which has a slower rise time and therefore more nearly approximates a portion of a sinusoidal wave. Such a waveform is beneficial for some applications, such as control of motor speed.

Figure 4:
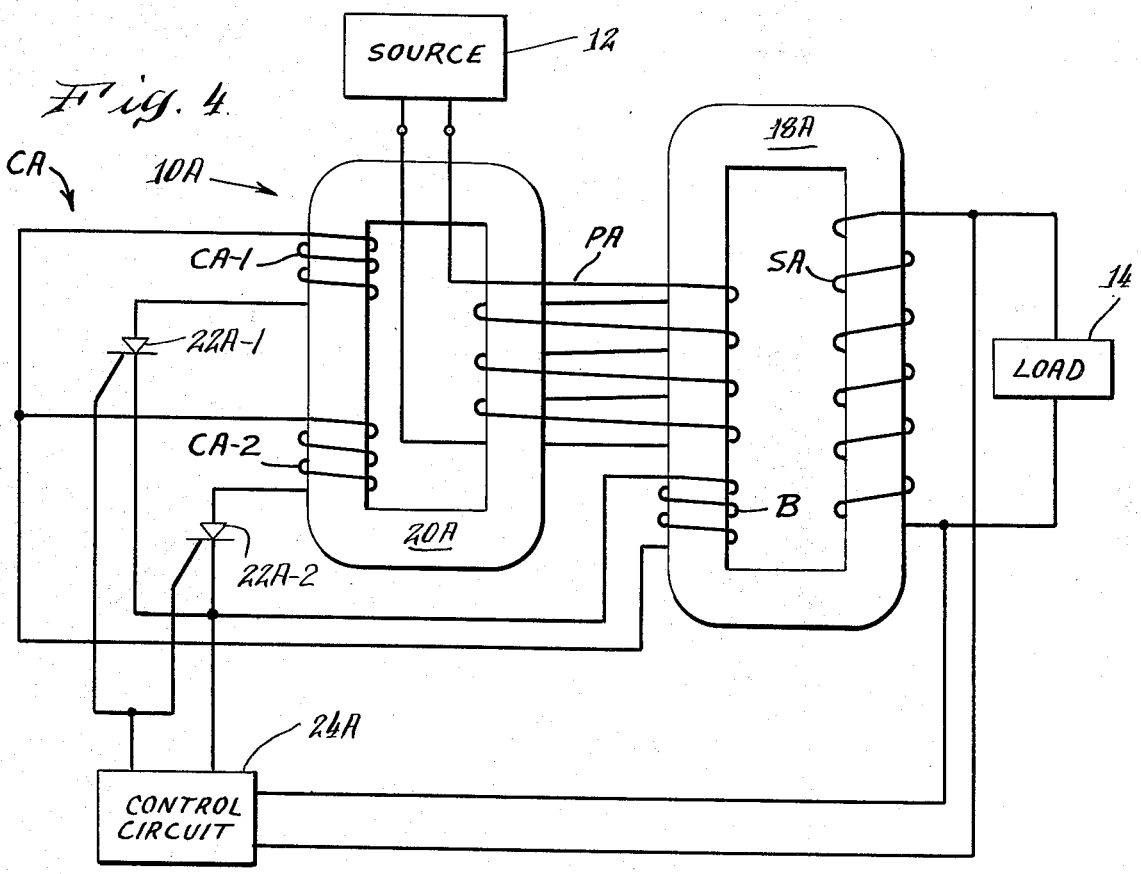

FIG. 4 illustrates a modified power transferring device 10A with a power core 18A and separate control core 20A. In contrast to the device shown in FIG. 1, however, device 10A has primary coil PA encircling the two cores 18A and 20A and secondary coil SA encircling only the power core 18A. The same range of control is obtained with device 10A as with device 10, but when secondary SA is disconnected from the load 14, full voltage continues to be generated across control coil CA whereas no such voltage is generated in the device of FIG. 1. For some types of control, one arrangement or the other may be more desirable.

As shown in FIG. 4, the control coil CA of power transferring device 10A is segmented into plural similarly wound coils CA-1 and CA-2, which are provided with separate short-circuiting switches 22A-1 and 22A-2 controlled by control circuit 24A. This arrangement allows large amounts of power to be controlled using low power switches 22A-1 and 22A-2 since the switches share in dissipating the power needed to cause the loading of the control core 20A.

Power transferring device 10A shown in FIG. 4 further illustrates a booster coil B encircling the power core 18A and connected additively with the control coils CA-1 and CA-2. Booster coil B insures that current will flow in coils CA-1 and CA-2 and that full loading of control core 20A will take place.

While the interchanged primary and secondary, the segmented control coil, and the booster coil are shown together on device 10A in FIG. 4, each of these features may be used independently of one another.

Another modified power transferring device 10B, illustrated in FIG. 5, comprises a single power core 18B encircled by a primary PB, and separate multiple control cores 20B-1 and 20B-2 with secondaries SB-1 and SB-2 each encircling a respective control core and the power core 18B. The control cores 20B-1 and 20B-2 are provided respectively with independent short-circuiting switches 22B-1, 22B-2 and control circuits 24B-1 and 24B-2, thereby allowing multiple loads to be driven from a single transformer with independent control.

FIG. 6 illustrates another power transferring device 10C in which the primary coil PC and secondary coil SC are connected in series to serve as an autotransformer, which may be arranged either for step-up or step-down operation. As shown in FIG. 6, one of the coils, in this case the secondary SC, is arranged to encircle both the power core 18C and the control core 20C, while the other coil, the primary PC, encircles only the power core PC. Operation of device 10C is similar to the operation of device 10 described previously.

FIG. 6 further illustrates a shunting resistor R across control coil CC. Shunting resistor R reduces the reactance of control core 20C, and permits some power to be transferred during a choked condition, the amount of power being determined by the value of resistor R. Accordingly, the resistor R may be made variable to set the range of control over which the control circuit 24C operates. For example, the resistor R may be set to permit control over a range of about 50 percent to 100 percent power transfer. Shunting resistor R may be used with the other power transferring devices described herein.

FIGS. 7 and 8 illustrate one practical form of construction for the power transferring device 10 shown schematically in FIG. 1. As shown in FIGS. 7 and 8, the cores 18 and 20 are rectangular, and secondary coil S encircles both the primary coil P and the control core 20. Another practical form of construction is shown in FIGS. 9 and 10, wherein the cores 18 and 20 are made from E-I laminations, the center legs of which are encircled respectively by the primary coil P and control coil C, with the secondary coil S encircling both the primary coil P and control coil C. Toroidal cores, useful for high frequency operation, can be constructed similarly, i.e., with the parallel toroidal cores each encircled respectively by the primary coil P and control coil C, and with the secondary coil S encircling both the primary coil P and control coil C.

Although specific embodiments of the invention have been disclosed herein in detail, it is to be understood that this is for the purpose of illustrating the invention, and should not be construed as necessarily limiting the scope of the invention, since it is apparent that many changes can be made to the disclosed structures by those skilled in the art to meet particular applications.

I claim:

1. A power transferring device of the type used for regulating or controlling the application of alternating current electric power to a load by means of a reactance controlled by selectively short-circuiting a control coil with a controllable short-circuiting switch, characterized by:

a power transformer having a power core and primary and secondary coils each encircling the power core and arranged for connection respectively to means acting as a source of alternating current electric power and to means forming a load;

a control core separate from the power core and encircled by the selectively short-circuited control coil;

one and only one of the primary or secondary coils being arranged to encircle both the control core and the power core, thereby to subject that coil to the controlled reactance of the control core;

the control core being arranged to subject the coil encircling both cores to essentially complete choking reactance without saturation of the control core when the control coil is open-circuited, thereby to substantially prevent power transfer between the primary and secondary coils;

the control coil loading the control core with the small resistance of the control coil and switch when the switch is short-circuited, thereby to transfer power substantially unimpeded between the primary and secondary coils;

whereby the control core and coil are enabled to efficiently control the transfer of power between the primary and secondary coils by selective opening and closing of the switch with little power dissipation occurring in the transferring device in either switch state.

2. A power transfer device as claimed in claim 1 wherein the one coil arranged to encircle both the control core and the power core is the secondary coil.

3. A power transfer device as claimed in claim 1 wherein the one coil arranged to encircle both the control core and the power core is the primary coil.

4. A power transfer device as claimed in claim 1 further comprising a booster coil encircling the power core and connected additively with the control coil.

5. A power transfer device as claimed in claim 1 wherein the control coil comprises two oppositely wound coils having the same number of turns and being connected in a closed series loop, the controllable switch being arranged to short-circuit each of the two oppositely wound coils to produce cancelling magnetic fluxes in the control core.

6. A power transfer device as claimed in claim 1 wherein the control coil is segmented into a plurality of segments each of which is shunted by a controllable short-circuiting switch, whereby each such switch dissipates a portion of the power used in saturating the control core.

7. A power transfer device as claimed in claim 1 wherein the secondary coil encircles both the control core and power core and further comprising at least one additional control core separate from the power core and encircled by an independent short-circuited control coil, and the power transformer having at least one additional secondary coil encircling the power core and the additional control core, whereby a plurality of independently controlled loads may be supplied from a single power transformer.

8. A power transfer device as claimed in claim 1 further comprising shunting resistor means connected across the control coil for decreasing the reactance of the control core.

9. A power transfer device as claimed in claim 1 wherein the control coil has approximately the same ampere turn capacity as the coil encircling both cores, thereby limiting current flow and power dissipation in the control coil and switch.

10. A power transfer device as claimed in claim 1 wherein the primary and secondary coils of the power transformer are connected to form an autotransformer.

11. A power transfer device as claimed in claim 1 wherein the controllable short-circuiting switch is a thyristor.

12. A power transfer device as claimed in claim 1 wherein the power and control cores are rectangular, and wherein the secondary coil encircles both the primary coil and the control core.

13. A power transfer device as claimed in claim 1 wherein the power and control cores are formed from E-1 laminations, and wherein the center legs of the cores are encircled respectively by the primary coil and control coil, and wherein the secondary coil encircles both the primary coil and control coil.

14. A power transferring device as claimed in claim 1 wherein the controllable short circuiting switch is arranged to selectively short circuit the control coil encircling the control core during alternate half cycles of the alternating current electric power applied to the primary, thereby to produce a first output wave on the secondary coil, and to remain open circuited during the opposite half cycles of alternating current, whereby the demagnetization of the control core during the opposite half cycles produces a second output wave of opposite polarity on the secondary coil, thus affording a full wave output on the secondary coil and efficient power transfer.

15. A power transferring device as claimed in claim 14 wherein the controllable short circuiting switch is a unilaterally conducting device.

16. A power transferring device as claimed in claim 15 wherein the unilaterally conducting device is an SCR.

17. A power transferring method for regulating or controlling the application of alternating current electric power to a load by means of a reactance controlled by selectively short circuiting a control coil with a controllable short circuiting switch, wherein the improvement comprises:

providing a power transformer having a power core and primary and secondary coils each encircling the power core and arranged for connection respectively to means acting as a source of alternating current electric power and a means forming a load, a control core separate from the power core and encircled by the selectively short circuited control coil, and one and only one of the primary or secondary coils being arranged to encircle both the control coil and the power core, selectively short circuiting the control coil encircling the control core with the short-circuiting switch during alternate half cycles of the alternating current electric power, thereby to produce a first output wave on the secondary coil; and maintaining the switch open-circuited during the opposite half cycles of alternating current, whereby the demagnetization of the control core during the opposite half cycles produces a second opposite polarity output wave on the secondary coil, thus affording a full wave output on the secondary coil and efficient power transfer.

* * * * *